US005280766A

United States Patent [19]

Mohn

[11] Patent Number: 5,280,766

[45] Date of Patent: Jan. 25, 1994

[54] SUBSEA PUMP SYSTEM

[75] Inventor: Frank Mohn, London, England

[73] Assignee: Framo Developments (UK) Limited, London, England

[21] Appl. No.: 836,014

[22] PCT Filed: Jun. 26, 1991

[86] PCT No.: PCT/GB91/01031

§ 371 Date: Mar. 30, 1992

§ 102(e) Date: Mar. 30, 1992

[87] PCT Pub. No.: WO92/00438

PCT Pub. Date: Jan. 9, 1992

[30] Foreign Application Priority Data

Jun. 26, 1990 [GB] United Kingdom ..... 9014237

[51] Int. Cl.[5] ..... E21B 33/03

[52] U.S. Cl. ..... 166/368; 166/379

[58] Field of Search ..... 166/77, 339, 341, 368, 166/379

[56] References Cited

U.S. PATENT DOCUMENTS 3,347,311 10/1967 Word, Jr. ..... 166/341
3,437,149 4/1969 Cugini et al. ..... 166/379
3,638,732 2/1972 Huntsinger et al. ..... 166/379
4,154,302 5/1979 Cugini ..... 166/378
4,331,203 5/1982 Kiefer .
4,363,168 12/1982 Bryer et al. ..... 166/341 X
4,391,330 7/1983 Kiefer .
4,462,464 7/1984 Brown et al. ..... 166/87
4,804,045 2/1989 Reed ..... 166/379 X

FOREIGN PATENT DOCUMENTS 0063444 10/1982 European Pat. Off. .

*Primary Examiner*—Ramon S. Britts
*Assistant Examiner*—Frank S. Tsay
*Attorney, Agent, or Firm*—Young & Thompson

[57] ABSTRACT

In a subsea fluid extraction system, the wellhead equipment comprises an X-mas tree on a guide base, the tree having a borethrough which can be run and retrieved a pump unit including an electric motor driving an impeller, the pump unit being suspended from a pump hanger in the X-mas tree by an elongate electrical conductor assembly consisting of concentric tubular conductors with insulating sleeves therebetween. An outer tube spaced around the conductors provides a fluid passage communicating through the pump unit with a second passage within the conductors for circulation of barrier fluid. Electrical supply to the pump unit is effected by a female connector located at the side of the X-mas tree which mates with an upright connector element on a transformer on the guide base.

19 Claims, 2 Drawing Sheets

SUBSEA PUMP SYSTEM

FIELD OF THE INVENTION

The invention relates to a subsea fluid extraction system including an electrically powered pump unit.

BACKGROUND OF THE INVENTION

In undersea fluid extraction systems, operational efficiency can be improved by the use of submersible pumps, in particular where production is from wells remote from a mother platform or fluid processing facility, so that the well effluent requires to be transported over substantial distances. Submersible pumps could also be used in multi-phase marginal field wells where the fluid is monophasic downhole. However electrically powered submersible pumps tend to be very prone to breakdown and are generally unreliable. Average operational times before failure may be only a few months. More often than not, failure is due to a damaged external power cable. Such pumps are accordingly unattractive economically because of the cost of frequent well shut-downs.

The present invention is concerned accordingly with the provision of a submersible pump system for subsea use which avoids the above-mentioned disadvantage.

SUMMARY OF THE INVENTION

The invention thus provides a subsea pump system in which an electrically powered pump unit can be run and retrieved by means of a relatively rigid, for example, pipe-like, conductor assembly by which the pump unit is energized in use.

The invention also provides, in wellhead structures for a subsea fluid extraction system, an X-mas tree which mounts an electrical conductor assembly carrying at least one electrically powered pump unit in a manner permitting running and retrieval of the pump unit through the X-mas tree.

The conductor assembly is conveniently constituted as a tubular assembly comprising concentric tubular conductors. Barrier or dielectric fluid supply or circulation is advantageously associated with the conductor assembly and appropriate piping can be included for this purpose.

The X-mas tree of the invention thus can comprise a hollow stem having at its upper end, which is normally closed by a protective cap, a hanger for the conductor assembly or power tubing. Production tubing extends downhole from the wellhead structure and the conductor assembly is suspended from the hanger so as to extend within it to define a space between the tubing and the assembly for the well effluent. Valving for the pumped effluent is carried by an X-mas tree block below the hanger.

The mounting of the conductor assembly or power tubing in the X-mas tree permits the pump unit to be run and retrieved on the rigid power tubing in a manner similar to a wire line operation, that is, the power tubing or assembly is run through the X-mas tree. In appropriate circumstances, the pump system can be run and pulled without killing the well.

The electrical conductor assembly can be suitably configured in accordance with the disclosures of EP 0 063 444 (FD½), and EP 0 089 121 (FE3), with conductor tubing surrounded by outer piping to constitute power tubing in which a barrier fluid can be circulated between the wellhead and downhole equipment. The conductor assembly can thus conveniently comprise a plurality of concentric tubular conductors, typically three for a 3-phase power supply, separated by solid insulation. External insulation for the tubular conductors can be effected similarly and/or by dielectric fluid, typically an insulating oil which may be circulated within and outside the conductor tubing by means of spaced outer tubing within which the conductor tubing is received.

The system of the invention thus includes no electric cabling susceptible to damage during running and pulling operations so the mean time before failure is expected to be substantially increased as compared with prior art systems, perhaps to two or three years, with evident economic advantage. Moreover, cable handling and feed-through equipment is rendered unnecessary.

A contribution to improved reliability is obtained by adoption of a barrier fluid system. Thus, a barrier fluid circulated by means of the power tubing can be employed for cooling lubrication and internal overpressure protection of downhole equipment. Additionally, or instead, the barrier fluid can be used to operate a deep set downhole safety valve (DHSV). No separate control line to the DHSV is then required, so a vulnerable item can be eliminated.

Electrical power supply connection and also fluid connection if required can be made to the hanger and thus to the power tubing by means of a female connector carried at a position to one side of the X-mas tree and adapted for a wet mateable connection with an upright connector element, which can be mounted on a transformer unit on the wellhead structure. An unbilical conveys the necessary supplies to the transformer unit. Alternatively, horizontal stab-in connections can be provided for between the transformer unit and the X-mas tree and/or between the umbilical and the transformer unit.

BRIEF DESCRIPTION OF THE DRAWINGS

The invention is further described below, by way of example, with reference to the accompanying drawings, in which.

DESCRIPTION OF THE PREFERRED EMBODIMENTS

Figure 1:
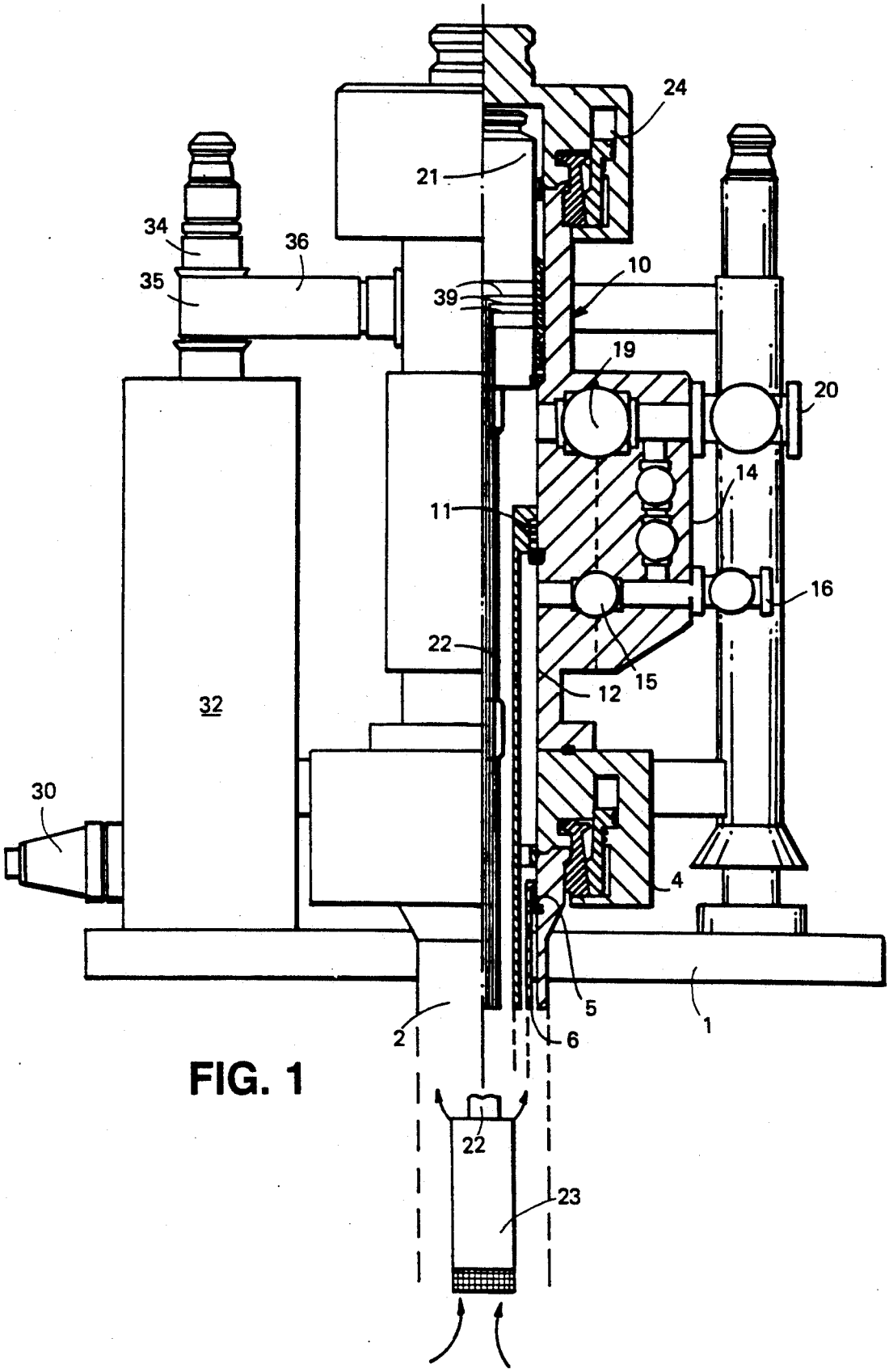
FIG. 1 of which is a side view, partly in sectional form, of wellhead equipment of a downhole pump system embodying the invention.
Figure 2:
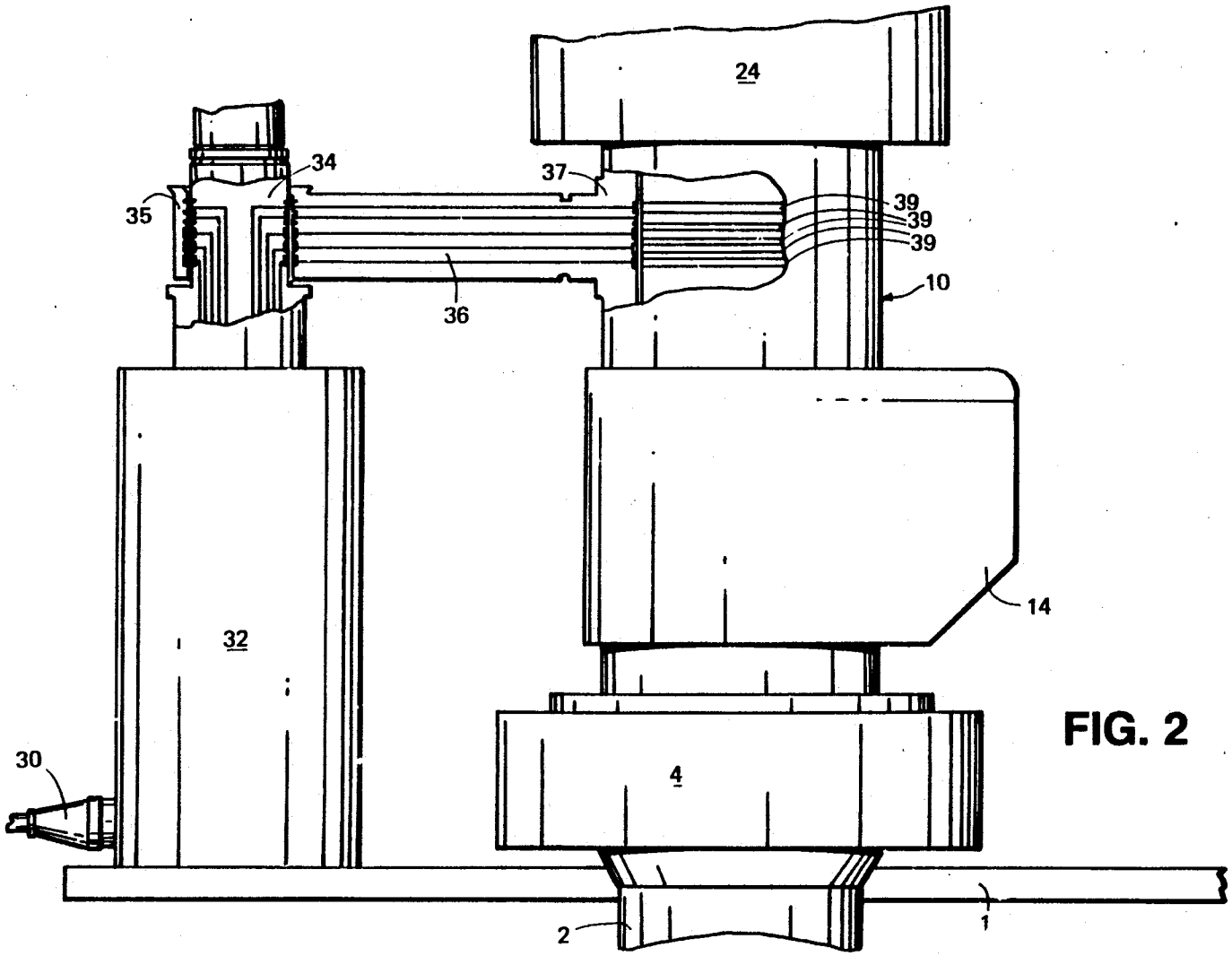
FIG. 2 is a similar partial view of the wellhead equipment on a larger scale, with parts broken away.

The subsea wellhead equipment illustrated is mounted on a permanent guide base 1. The base supports production tubing 2 extending downhole through a central aperture in the guide base and comprising an upper tubing end portion above the guide base to which is secured a wellhead connector 4. Internally of the tubing 2 is a casing hanger 5 for 24.45 cm (9⅝ inches) casing 6. Above the wellhead connector is located an X-mas tree 10 supporting within it a hanger 11 for 17.78 cm (7 inches) tubing 12 extending downhole concentrically within the casing 6.

Valving for the well effluent is located above the connector 4. Thus, the annular space between the casing 6 and the tubing 12 is communicated outwardly of an X-mas tree block 14 through a master valve 15 and a wing valve 16. The space within the tubing 12 is similarly communicated outwardly through a master valve 19 and a wing valve 20 in the block 14.

The upper part of the X-mas tree 10 has releasably secured within it a pump hanger 21 from which there extends downhole conductor or power tubing 22 carrying at its lower end a pump unit 23, shown schematically comprising suitable pump or impeller means driven by an electric motor. A protection cap 24 closes off the upper end of the X-mas tree 10. The pump hanger 21 serves additionally as a mechanical seal barrier in the X-mas tree. An additional plug with seals can be installed between the pump hanger 21 and the protection cap 24 to provide an extra seal barrier against the well if deemed necessary. The power tubing 22 comprises an assembly of three concentric electrical conductor tubes with insulating sleeves between them, surrounded by outer tubing with spacing from the conductor assembly. The interior of the conductor assembly and the space between it and the outer tubing provide flow and return paths for barrier fluid, typically a dielectric oil.

Fluid and electrical power supply connections from an umbilical 30 are made to the hanger 21 and thence to the power tubing 22 by way of a transformer unit 32 mounted on the guide base 1 adjacent the X-mas tree 10. At the top of the transformer unit a connector element 34 extends upright so as to make a wet mateable connection with a passive vertical female connector element 35 carried at the free end of an arm 36 projecting laterally from the X-mas tree. The connector elements 34 and 35 provide concentric electrical and fluid communications and the inner end of the arm 36 at 37 constitutes, in effect, a similar but permanent connection with electrical conductors and fluid passages 39 within the pump hanger 21. This arrangement permits vertical installation of the hanger 21 and the X-mas tree 10 with automatic establishment of the electrical and barrier fluid connections upon landing.

Alternatively, a horizontal stab multi-connector, with hydraulic stroking, could be employed at the X-mas tree interface, in replacement of the wet mateable connector above the transformer unit 31. This permits independent installation and retrieval of the transformer unit and the X-mas tree, in any desired sequence.

Yet again, a horizontal stab multi-connector could be employed at the umbilical head, with a permanent or "hard-pipe" connection between the transformer unit and the X-mas tree. This permits the umbilical to be installed and retrieved independently of the module comprising the X-mas tree and the transformer unit, thereby extending the operational water depth of the system and limiting the risk of damage to the umbilical.

These two possibilities could be combined to maximize access and interdependability, but with an undesirable increase in the number of subsea connections.

The power tubing 22 is conveniently constructed of sections of 12–15 metres length with conventional pin-down and box-up connections for the outer tubing sections. The electrical conductor tubing is in corresponding lengths and is suspended within each tubular section by suitable spacing elements. Each length of the conductor tubing is configured at each end to ensure electrical continuity for the respective conductor tubes throughout its length from the wellhead to the pump unit.

Whatever connection arrangements are provided at the wellhead equipment, the pump unit 23, connected directly to the power tubing 22 so as to be carried thereby, can be run down the production tubing through the X-mas tree 10 during installation, to be landed at a predetermined setting depth on a landing shoulder with a seal nipple which is integrated into the downhole completion assembly. Sealing to the X-mas tree 10 is effected by the seal arrangements described above. Conversely, retrieval of the pump unit 23 can be effected by lifting the production tubing to carry the pump unit up through the X-mas tree.

The invention can of course be embodied in other ways than as specifically described and illustrated.

I claim:

1. In a subsea fluid extraction system, wellhead equipment comprising:

an X-mas tree having a bore extending therethrough, elongate conductor means comprising a plurality of tubular conductors, an electrically powered pump unit suspended by said elongated conductor means, said pump unit and said elongate conductor means being adapted to be run and retrieved through said bore, hanger means in said X-mas tree engaged by said elongate conductor means for supporting said pump unit from said X-mas tree, and electrical connector means included in said hanger means electrically communicating each of said plurality of tubular conductors externally of said X-mas tree.

2. The wellhead equipment of claim 1, wherein the elongate conductor means comprises three concentric tubular conductors and two sleeves of insulating material insulating each conductor from the others.

3. The wellhead equipment of claim 1, further comprising means defining at least one fluid passage extending adjacent said elongate conductor means and communicating said X-mas tree with said pump unit.

4. The wellhead equipment of claim 1, wherein said plurality of tubular conductors comprise concentric conductors providing a first fluid passage therewithin and tubular insulators between said conductors, and further comprising tubing around said concentric conductors, said tubing providing a second fluid passage between said tubing and said concentric conductors.

5. The wellhead equipment of claim 1, wherein said hanger means provides a mechanical barrier seal in said X-mas tree.

6. The wellhead equipment of claim 1, further comprising an electrical supply source located adjacent said X-mas tree and first electrical contacts on said supply source, and wherein said electrical connector means extend laterally of said X-mas tree to second electrical contacts engaging with said first electrical contacts to establish electrical supply from said source to said pump unit.

7. The wellhead equipment of claim 6, wherein said first and said second electrical contacts are releasably engageable on landing of said X-mas tree at said wellhead equipment.

8. The wellhead equipment of claim 1, further comprising means providing at least one fluid passage extending along said elongate conductor means and communicating said X-mas tree and said pump unit.

9. Wellhead equipment for a subsea fluid extraction system, comprising:

a guide base, an X-mas tree retrievably mounted on said guide base and having a bore extending therethrough, elongate conductor means, an electrically powered pump unit suspended by said elongate conductor means, said pump unit and said elongate conductor means being adapted to be run and retrieved through said bore, hanger means in said X-mas tree engaged by said elongate conductor means whereby said pump unit is suspended from said X-mas tree by way of said elongate conductor means, first electrical connector means within said X-mas tree releasably connecting with said elongate conductor means on running of said pump unit, an electrical supply source mounted on said guide base adjacent said X-mas tree, and second electrical connector means extending laterally from said X-mas tree and releasably electrically connecting said electric supply source with said first electrical connector means, said second connector means being connectable with said supply source and separable therefrom by substantially vertical movement on landing of said X-mas tree on said guide base, and on retrieval of said X-mas tree from said guide base respectively.

10. The wellhead equipment of claim 9, wherein said elongate conductor means comprises a plurality of tubular conductors.

11. The wellhead equipment of claim 9, wherein said second connector means includes a female connector element and wherein said electrical supply source includes an upright connector element receivable within said female connector element.

12. The wellhead equipment of claim 11, wherein said female and upright connector elements are adapted to make a wet mateable connection.

13. The wellhead equipment of claim 9, further comprising:

passage means defining at least one fluid passage extending along said elongate conductor means, first fluid connector means within said X-mas tree releasably connecting with said passage means on running of said pump unit, a fluid source adjacent said electrical supply source, and second fluid connector means extending laterally from said X-mas tree and releasably electrically connecting said fluid source with said first fluid connector means, said second fluid connector means being connectable with said fluid source and separable therefrom by substantially vertical movement on landing of said X-mas tree on said guide base, and on retrieval of said X-mas tree from said guide base respectively.

14. The wellhead equipment of claim 13, wherein said elongate conductor means comprises a plurality of concentric tubular conductors and insulating sleeves between said conductors and wherein said passage means comprises tubing concentric with said tubular conductors.

15. A subsea wellhead installation comprising:

an X-mas tree having a bore extending substantially vertically therethrough, an elongate electrical conductor assembly, said assembly comprising a plurality of concentric tubular conductors and at least one sleeve of insulating material between adjacent ones of said tubular conductors.

a pump unit carried by said conductor assembly at a first end region thereof, said pump unit comprising impeller means and an electric motor driving said impeller means in response to electrical energization of said motor by way of said conductor assembly, said pump unit and said conductor assembly being adapted to be run and retrieved through said bore, and means in said X-mas tree releasably mechanically and electrically engaging said conductor assembly at a second end region thereof for suspending and electrically energizing said pump unit from said X-mas tree by means of said conductor assembly.

16. The wellhead installation of claim 15, further comprising tubing defining with said electrical conductor assembly a fluid passage communicating said X-mas tree with said pump unit.

17. The wellhead installation of claim 16, wherein said tubing surrounds said conductor assembly with spacing constituting said fluid passage and wherein said concentric tubular conductors have an interior constituting a second fluid passage communicating said X-mas tree with said pump unit.

18. Wellhead installation of claim 15, further comprising an electrical supply source located adjacent said X-mas tree and first electrical contacts on said supply source, and wherein said means electrically engaging said conductor assembly extending laterally of said X-mas tree to second electrical contacts engaging with said first electrical contacts to establish electrical supply from said source to said pump unit.

19. The wellhead installation of claim 18, wherein said first and second electrical contacts ar releasably engageable on landing of said X-mas tree at said wellhead installation.

* * * * *